US009378620B2

(12) United States Patent
Soong

(10) Patent No.: US 9,378,620 B2
(45) Date of Patent: Jun. 28, 2016

(54) GAMING DEVICE, SYSTEM AND METHOD FOR AWARDING A PROGRESSIVE PRIZE THROUGH FREE PLAYS OF A GAME FEATURE

(71) Applicant: Bally Gaming, Inc., Las Vegas, NV (US)

(72) Inventor: Shawn Soong, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 257 days.

(21) Appl. No.: 14/311,018

(22) Filed: Jun. 20, 2014

(65) Prior Publication Data

US 2015/0011306 A1 Jan. 8, 2015

Related U.S. Application Data

(60) Provisional application No. 61/842,252, filed on Jul. 2, 2013.

(51) Int. Cl.
*G07F 17/32* (2006.01)

(52) U.S. Cl.
CPC ..... *G07F 17/3258* (2013.01)

(58) Field of Classification Search
USPC ..... 463/26, 27, 28
See application file for complete search history.

(56) References Cited

U.S. PATENT DOCUMENTS

2006/0073888 A1* 4/2006 Nguyen ..... G06F 17/32 463/27
2011/0111844 A1* 5/2011 Anderson ..... G07F 17/32 463/27
2013/0116032 A1* 5/2013 Lutnick ..... G07F 17/3276 463/17
2014/0094292 A1* 4/2014 Nguyen ..... G07F 17/32 463/26
2014/0370958 A1* 12/2014 Lutnick ..... G07F 17/3276 463/17
2016/0055718 A1* 2/2016 Lyons ..... G07F 17/3258 463/27

* cited by examiner

*Primary Examiner* — Pierre E Elisca
(74) *Attorney, Agent, or Firm* — Philip J. Anderson; Marvin A. Hein

(57) ABSTRACT

A gaming device, system and method are set forth which includes a progressive jackpot pool. Based upon a trigger condition at least a portion of the pool value PV is awarded to a player by providing free plays of a feature where each free play has an expected value EV. The number of free plays awarded is substantially PV/EV and where PV/EV includes a non-integer remainder R a remainder game having odds R/EV is played and if won an additional free play is awarded. The progressive trigger may be a mystery trigger. The free plays may be free spins of the gaming machine base game or one or more different games.

20 Claims, 12 Drawing Sheets

GAMING DEVICE, SYSTEM AND METHOD FOR AWARDING A PROGRESSIVE PRIZE THROUGH FREE PLAYS OF A GAME FEATURE

CROSS-REFERENCE TO RELATED APPLICATIONS

This application is a non-provisional application that claims priority to U.S. Provisional Application No. 61/842,252 filed Jul. 2, 2013.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention relates to gaming devices, methods and systems which accumulate a progressive prize and award the same to one or more players upon occurrence of a trigger condition. More particularly it relates to gaming devices, methods and systems which accumulate a mystery progressive prize.

2. Background

Various types of gaming devices have been developed with features designed to captivate and maintain player interest. In general, a gaming machine allows a player to play a base game of chance in exchange for a wager. In pay to play (P2P) gaming the wager has value such as wagering currency or credits representing currency. For novelty or "entertainment only" play the wagers are fictitious credits having no redemption value. Las Vegas style slot machines are an example of P2P gaming devices. Depending on the outcome of the base game, the player may be entitled to an award which is awarded to the player by the gaming machine, normally in the form of currency or game credits. Gaming devices may include flashing displays, lighted displays or sound effects to capture a player's interest in a gaming device.

Many modern gaming devices incorporate a secondary, feature or bonus game. These secondary games may be triggered by one or more outcomes from the base game such as, for example, a predefined symbol combination. These types of triggers are sometimes referred to as symbol driven triggers since they are determined by base game symbols. When the symbol combination occurs the gaming device processor enables the display for play of a secondary game. The secondary game may take the form of a number of free plays of the base game, a random selection game where the player selects from displayed offerings to reveal prizes, the play of a secondary game or the like.

In addition to symbol driven triggers there is also known to provide mystery prizes to players over and above any awards from the play of the base game or any base game symbol triggered feature. Often these mystery prizes are progressive prizes which may be arranged in triggered in a variety of manners. For example, in Olive, U.S. Pat. No. 7,108,603 issued Sep. 19, 2006 and titled "Slot Machine Game and System with Improved Jackpot Feature" there is a disclosed networked gaming machines contributing, from the wagers for the play of the base games, to a progressive jackpot. Based upon the value of the wager W at a gaming device to play a base game and the predetermined turnover for the jackpot, virtual lottery is conducted (out of sight of the player) with each base game play where the odds of winning relate to the wager W and jackpot turnover amount. When the feature is triggered play of a feature game determines the size of the award based upon a score from the feature game. Torango, U.S. Pat. No. 6,592,460 issued Jul. 15, 2003 and titled "Progressive Wagering System" discloses a similar type of "hidden lottery" type of mystery prize. In Acres et al U.S. Reissued patent RE38,812, reissued Oct. 4, 2005 and titled Method and Apparatus for operating Networked Gaming Devices", the disclosure of which is incorporated by reference, there is disclosed a system based mystery jackpot which is triggered when the progressive pool reaches a selected (and unrevealed) amount.

A drawback to these prior mystery award techniques is that they either simply award an amount as determined by the system and/or progressive controller, for example the amount of the progressive jackpot pool when the mystery is triggered or, provide for the play of a single feature game. For example, in Olive U.S. Pat. No. 7,108,603 when the feature is triggered the player plays a feature "spin and hold" game and based upon the score range a selected award is issued to the player.

It would be advantageous to provide a progressive prize which has a prize value PV when the prize is triggered, where the PV is awarded by a series of free game plays each play resulting in a random winning or losing outcome, awards for winning outcomes and an expected value (EV) and where the number of free plays at least approximates PV/EV. It would further be advantageous, where EV is not an aliquot of PV to provide a system, apparatus and method for accounting for any remainder of a fraction of free plays where EV is not an aliquot of PV. It would further be advantageous to provide one or more feature trigger types in such apparatus, systems and methods.

SUMMARY OF THE INVENTION

There is, therefore, set forth according to the present invention, a gaming device is set forth which includes a display. The gaming device may be a gaming machine such as found in a casino venue or may be a computer or mobile device. The display may be a video display, electro-mechanical display or a combination. More than one display may be provided. One or more data structures such as a flash memory and/or hard drive stores software code for the operation of the play of one or more base games and one or features as well a corresponding graphics, sound and text. The feature includes a series of free plays each having an expected value EV. A processor such as the game processor is configured to access the one or more data structures to control the one or more displays for display of the base game and feature to the player. One or more of the processor and progressive controller accumulates a progressive jackpot pool P which may have a minimum value $V_{Min}$ and a maximum value $V_{Max}$. A feature trigger is provided such as a trigger occurring from the play of the base game or other event. In an embodiment the trigger is a mystery trigger. When the trigger condition is satisfied and feature is triggered and a progressive jackpot amount value PV is determined to be awarded to the player. Based upon PV and EV the feature awards a number of free plays approximately equal to PV/EV. Where EV is not an aliquot of PV (i.e. PV/EV=Integer+remainder R (R<1) the feature includes play of a remainder game to determine if an additional free play will be awarded where the odds of be awarded the free game are substantially equal to R/EV.

In an embodiment the feature may be free spins of a spinning reel game, a roulette game, Keno or Bingo game or the like.

Also set forth a system for a plurality of gaming devices each including a display for displaying one or more base games and one or more features. The gaming devices are linked on a network a progressive prize pool P is provided. The progressive prize pool P may be accumulated from portions of P2P wagers at the gaming devices, fictitious credits or by external sources such as marketing dollars for a casino or hosting site. Each feature includes a series of free plays where each free play has an expected value. When a feature trigger condition is detected one or more of a game processor and progressive controller awards a progressive jackpot prize value PV through a number of free plays where the number is substantially equal to PV/EV. Where EV is not an aliquot of PV (i.e. PV/EV=Integer+remainder) where R (R<1) the feature includes play of a remainder game to determine if an additional free play will be awarded where the odds of be awarded the free game are substantially equal to R/EV.

In various embodiments a method is set forth wherein a portion of wagers from networked gaming devices is allocate to a progressive jackpot pool. When a jackpot award trigger condition is determined the method includes enabling a feature of a number of free plays substantially equal to PV/EV where PV is the award prize value when the feature is enabled and EV is the expected value of each feature free play. Based upon the theoretical EV and the number of free plays the total award for the series of free plays should, theoretically, substantially equal the prize value PV, but in actuality for any feature the total feature award may greater or lesser than PV.

Where the award value PV and expected value EV are such that EV is not an aliquot of PV (i.e. PV/EV=Integer+remainder) where R (R<1) the feature includes play of a remainder game to determine if an additional free play will be awarded where the odds of be awarded the free game are substantially equal to R/EV.

In various embodiments the trigger condition may be based upon a coin-in mystery, a stand-alone mystery, a lottery based mystery or any other mystery trigger.

Other features and advantages will become evident upon review of the following description and drawings.

DETAILED DESCRIPTION

Figure 1:
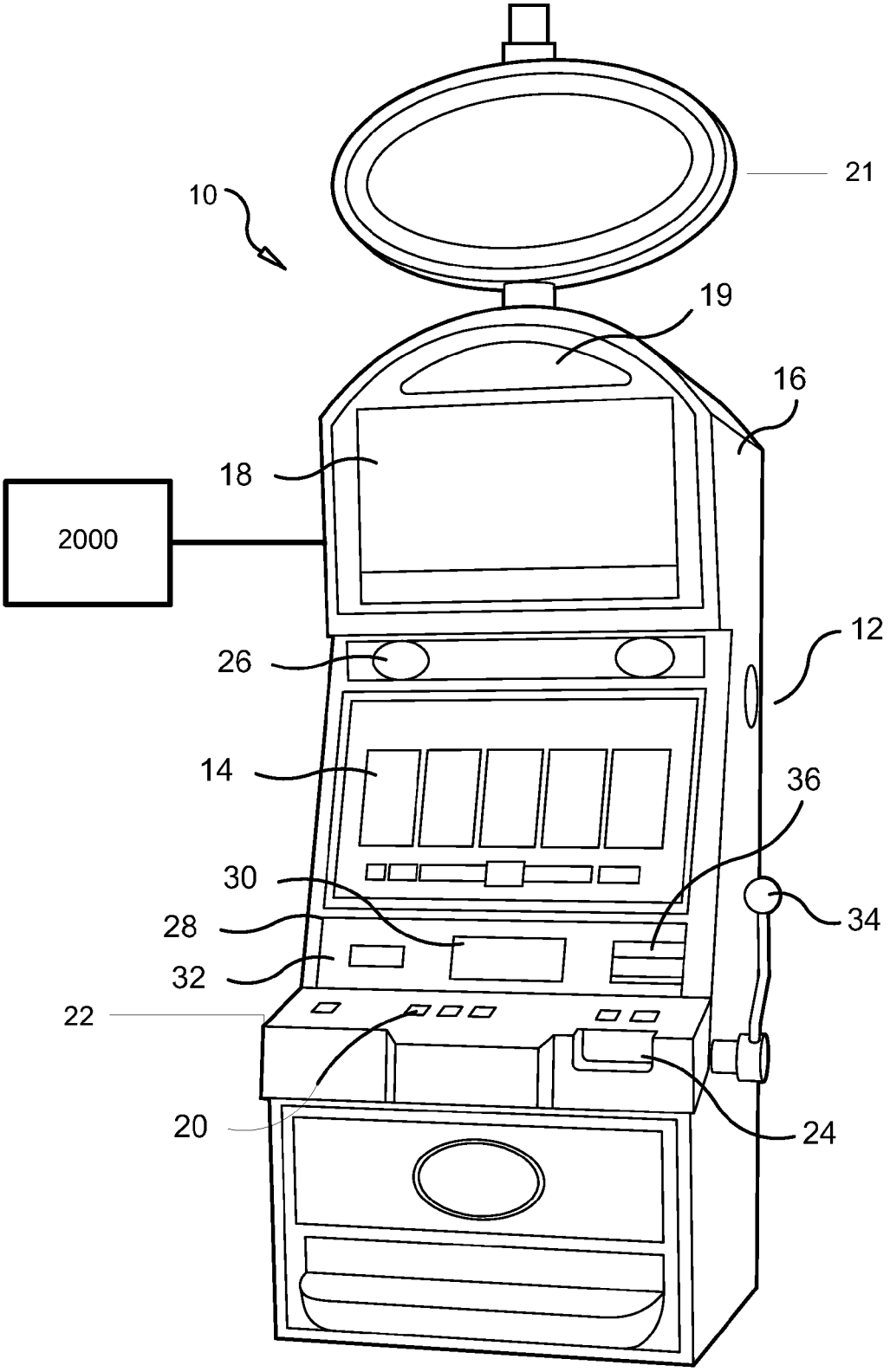
FIG. 1 illustrates a gaming device.

Referring now to the drawings, wherein like reference numbers denote like or corresponding elements throughout the drawings, and more particularly referring to FIG. 1, a gaming device 10 according to the various embodiments of the present invention. The gaming device 10 includes cabinet 12 providing an enclosure for the several components of the gaming device 10 and associated equipment. A primary game display 14 is mounted to the cabinet 12. The primary game display 14 may be a video display such as an LCD, plasma, OLED or other electronic display as are known in the art. The primary game display 14 may also be embodied as a combination of two or more electronic displays disposed in an adjacent overlapping or overlying arrangement or may be embodied as an electro-mechanical display such as a stepper-base slot machine or a combination of video and electro-mechanical displays as is known in the art. The primary game display 14 may be mounted to one or more of a door for the cabinet 12 or the cabinet chassis itself. The primary game display 14 is located to display game content (and if desired other content) to the player. For example, the game content may be base game outcomes presented by a plurality of video spinning reels displaying symbols the combinations of which define winning or losing outcomes, video Poker, Keno or other form of base casino wagering game as is known in the art. While the following description of the various embodiments of the present invention is directed to video reel-spinning games, it should be understood that the invention could be applied to other games including those mentioned above as well. Features such as bonus/feature games including the type described herein may also be presented at the primary game display 14 as hereinafter described. The foregoing description should not be deemed as limiting the content (graphics, video or text) which can be displayed at the primary game display 14. Touch screen input functionality may be associated with the primary game display 14 to enable the player to interact with the video content such as the game.

The gaming device 10 also includes in one or more embodiments a top box 16 which may support a printed back-lit glass (not shown) as is known in the art depicting the rules, award schedule, attract graphics or it may support a secondary game display 18 which may be of one of the types described above with reference to the primary game display 14. The top box 16 may also support a backlit glass with graphics defining a marquee 19 and a topper 21 including additional graphics. These video displays such as the primary display 14 and secondary display 18 may be standard 17 or 19 inch CRT or flat panel video displays.

While the gaming device 10 described above includes only two video displays it should be understood that some gaming devices have three or more. For example the topper 21 could include or be replaced by a third video display.

To enable a player to provide input to the controller for the gaming device 10 a plurality of buttons 20 may be provided on a button deck 22 for the gaming device 10. Additionally and alternatively one or both of the primary and secondary game displays 14, 18 may include touch screen input interface(s) as are known in the art. Most typically inasmuch as the primary game display 14 is positioned nearer the player and in a position for player touch interaction, only the primary display 14 has touch screen functionality.

Video content for display at the primary and secondary displays 14, 18 is crafted by designers to be adapted for display at one or more of the displays. For example, a video spinning real slot machine game and bonus and secondary features are designed to be displayed solely at the primary game display 14 for play and interaction by the player. Meters (credit and win meters) are also typically displayed at the primary display 14 as well has other icons such as a "Help Screen" call-up icon and touch enabled icons to, for example, select pay lines to play and wagers per selected pay line. Video content for the secondary display 18 may include, by way of example only, video content to identify the game, animated of video content to attract players to the game, the game pay table (as well as highlighting wins on the pay table as they occur, progressive jackpot information or the like. It has been known to, in features triggered from the base game, simultaneously display cooperative video content on both of the primary and secondary displays 14, 18. It should be understood that for gaming devices 10, for the most part, the video content for the primary and secondary displays 14, 18 is related (since there is a common game theme presentation) but is different.

Buttons, selections or inputs are displayed at the primary game displays 14 and the player touching those icons or designated areas provides the required or desired input to configure and play the gaming device 10. The buttons 20 may be displayed and defined at a touch screen button panel interface of the type described in Kelly et al U.S. Pub. 2010/0113140A1 filed Nov. 16, 2009 and titled "Gesture Enhanced Input Device", the disclosure of which is incorporated herein. The touch screen button panel includes its video display which is smaller than the primary game display 14.

Other peripherals or associated equipment for the gaming device 10 include a bill/voucher acceptor 24 which reads and validates currency and vouchers for the player to establish credits for gaming on the gaming device 10 and one or more speakers 26 to provide audio to the player in association with the game play. To provide for communication between the gaming device 10 and a casino system, a player tracking module (PTM) 28 is mounted on the cabinet 12. PTM 28 has a PTM display 30 to display system related information to the player. The PTM display 30 may be a small LCD, plasma or OLED display with touch screen functionality. In an embodiment the community games and features described herein are displayed at the PTM display 30; however, as set forth below these presentations are preferably migrated to areas at the primary or secondary displays 14, 18. A card reader 32 is provided to read a machine readable component on a player loyalty card issued to the player to identify the player to the casino system as in known in the art. A ticket printer 36 may be provided as well on the PTM 28 or elsewhere on the gaming device 10 to provide printed value ticket vouchers to players as is known in the art.

Some functionality of the PTM 28 may be provided by a video switcher and touch router device as is described in U.S. Pub. App. 2009/0149253 entitled "Video Switcher and Touch Router Method for a Gaming Machine" filed Jan. 8, 2009 the disclosure of which is incorporated by reference. System and externally based content including the community game presentations, player information, advertisements features as described herein or other information may be displayed at areas at one or more of the primary or secondary displays 14, 18 dispensing with the need for the separate PTM display 30. According to the disclosure of U.S. Pub. App. 2009/0149253 when system content as well as an embodiment of the feature described herein are presented at the primary game display 14, the presentation of the base game played by the player is sized to share display real estate with the system content and/or feature as hereinafter described. The touch screen interface is also configured to interpret input "touches" from a player as relating to the base game content or the systems based content sharing the primary game display 14 real estate.

While the player may use the buttons 20 to prompt play of the game (or the touch screen input), alternatively the player may use a handle 34 to prompt an input as is known in the art.

Cabinet 12 may be a self-standing unit that is generally rectangular in shape and may be manufactured with reinforced steel or other rigid materials which are resistant to tampering and vandalism. Any shaped cabinet may be implemented with any embodiment of gaming device 10 so long as it provides access to a player for playing a game. For example, cabinet 12 may comprise a slant-top, bar-top, or table-top style cabinet, including a Bally Cinevision™ or CineReels™ cabinet. The gaming device 10 may include a controller and memory disposed within the cabinet 12 or may have thin client capability such as that some of the computing capability is maintained at a remote server.

The plurality of player-activated buttons at the button deck 22 may be used for various functions such as, but not limited to, selecting a wager denomination, selecting a game to be played, selecting a wager amount per game, initiating a game, or cashing out money from gaming machine 10. Buttons may be operable as input mechanisms and may include mechanical buttons, electromechanical buttons or touch screen buttons. In one or more embodiments, buttons may be replaced with various other input mechanisms known in the art such as, but not limited to, touch screens, touch pad, track ball, mouse, switches, toggle switches, or other input means used to accept player input. For example, one input means is as disclosed in U.S. Pub. App. 2011/0111853, entitled "Universal Button Module," filed on Jan. 14, 2011 and/or U.S. Pub. App. 2010/0113140 entitled "Gesture Enhanced Input Device" filed Nov. 16, 2009 which are hereby incorporated by reference. Player input may also be by providing touch screen functionality at the primary game display 14 and/or secondary game display 18.

The primary game display 14, according to the present invention, is controlled to present at least one instance of a base game of chance wherein, after making a wager of value, a player receives one or more outcomes from a set of potential outcomes. For example, one such game of chance is a video slot machine game. In other aspects of the invention, gaming machine 10 may present a video Keno game, a lottery game, a bingo game, a Class II bingo game, a roulette game, a craps game, a blackjack game, a mechanical or video representation of a wheel game or the like. The primary game display 14 may be controlled to present and play multiple instances of concurrent games.

According to the present invention a progressive such as a standalone progressive, LAN progressive or system based progressive (WAN progressive) is provided. The software and processing for the progressive may be included in the game CPU and memory structure or may be provided by a separate progressive controller 2000 included in the gaming device 10 and communicating with the game CPU. Where the progressive is a WAN based progressive, as discussed below, the progressive controller 2000 may be included as a software module at one or more system servers. The progressive controller 2000 may be in communication with one or more displays such as the primary display 14 or a large display (not shown) associated with one or more groups of gaming machines. In an embodiment the progressive controller 200 could be incorporated into the software/firmware of the PTM 28 or other related processor controlled equipment. The progressive controller 2000 may act in concert with the game CPU to provide the features herein described. These features may also be provided, as suggested above, by the game CPU or by the progressive controller 2000 alone. Accordingly the progressive controller 2000 includes a processor and data structure for performing the tasks and features recited herein.

Figure 2A:
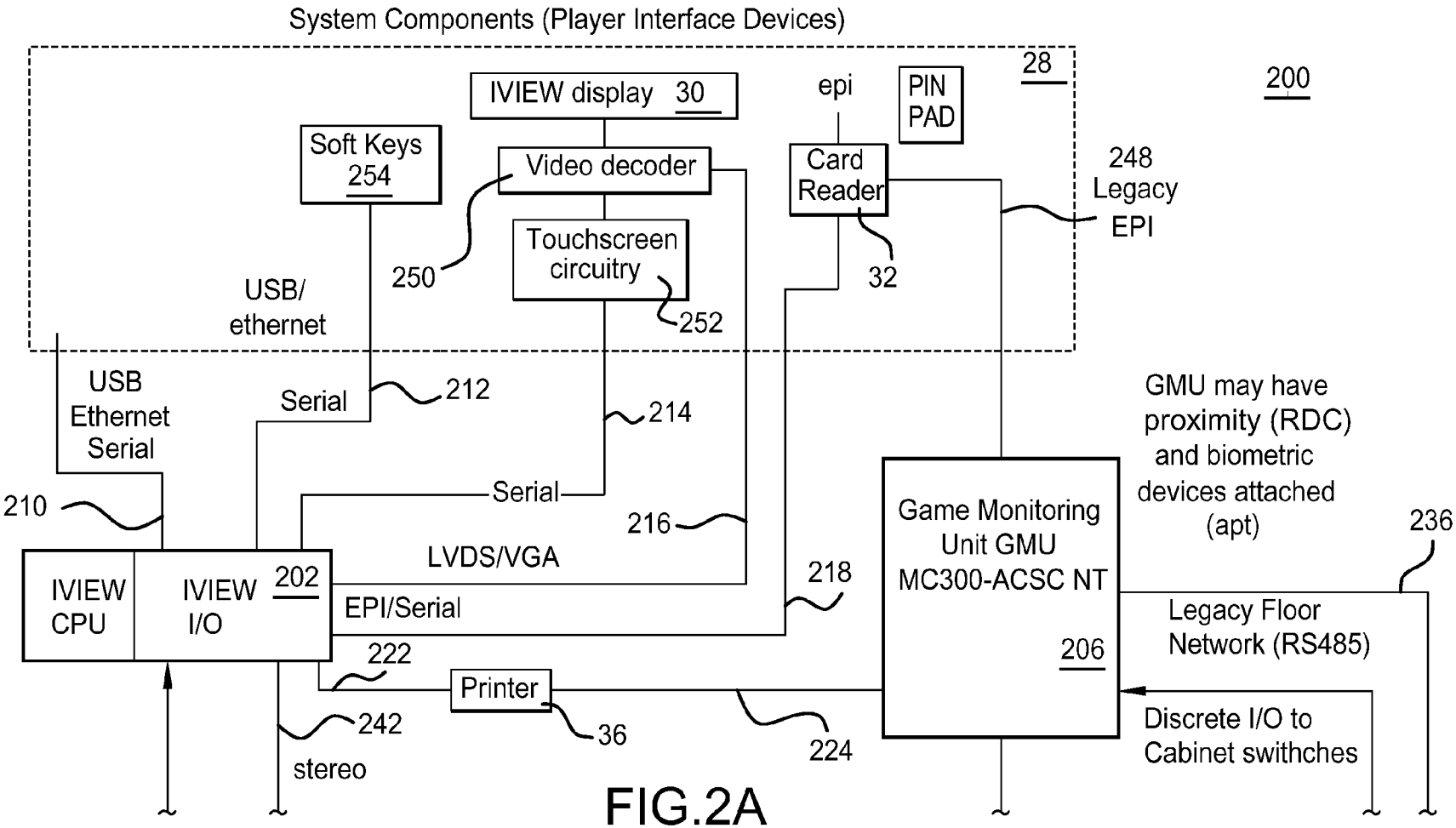
FIGS. 2A-2B illustrate an example of a gaming device operational platform and components for a gaming terminal of the type of the present invention.
Figure 2B:
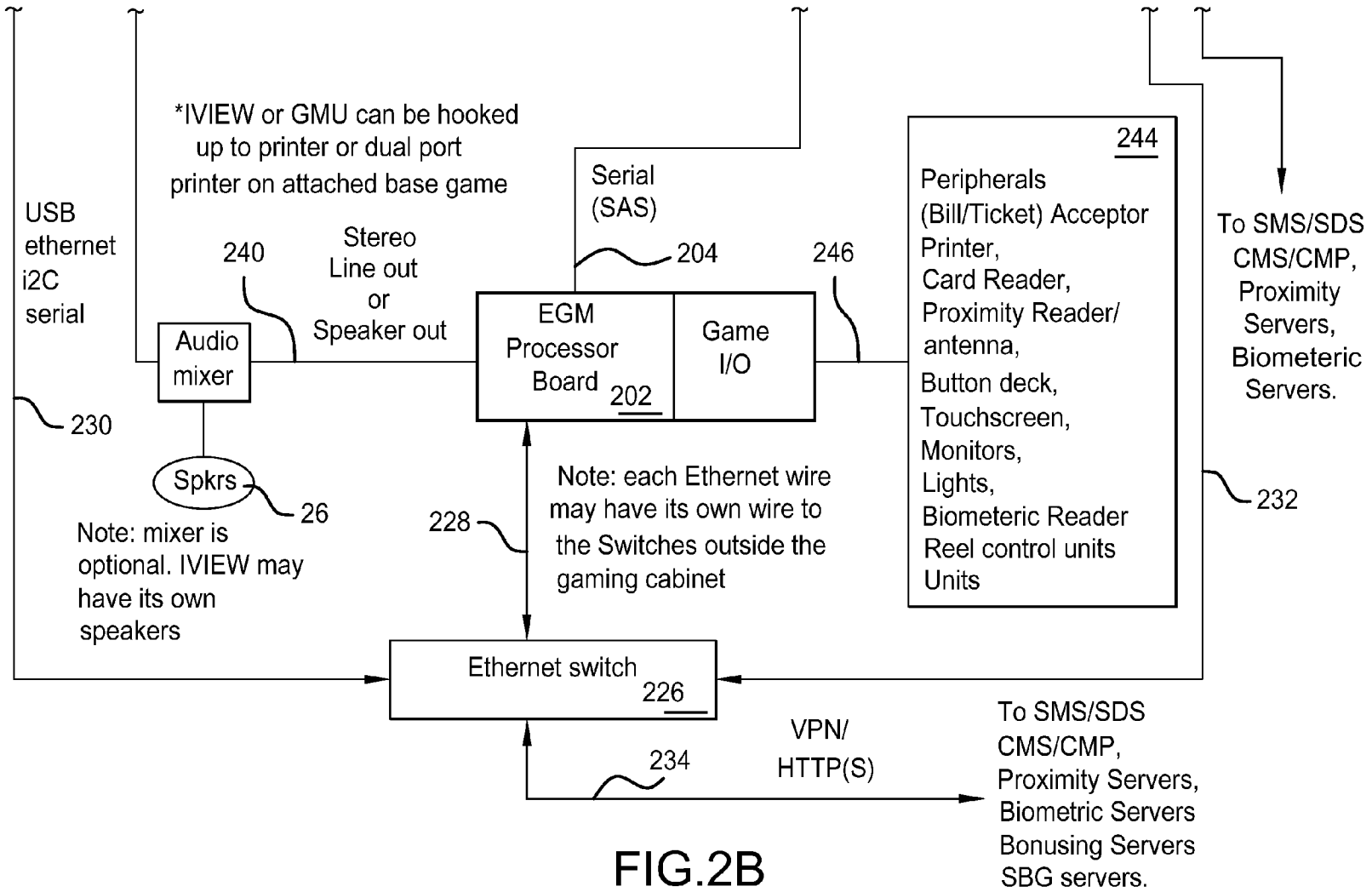

Referring to FIGS. 2A, B, the gaming device 10 hardware 200 for the controller(s) is shown in accordance with one or more embodiments. The hardware 200 includes game processor board 202 (EGM Processor Board), sometimes referred to herein as the game CPU or game processor, connected through serial bus line 204 to game monitoring unit (GMU) 206 (such as a Bally MC300 or ACSC NT manufactured and sold by Bally Gaming, Inc., Las Vegas, Nev.), and player interface CPU/input-output device 202 (CPU 202) connected to the player tracking module (PTM) 28 over bus lines 210, 212, 214, 216, 218. The game processor board 202 includes one or more processors and memory devices for the control of inputs and outputs to operate the game. At least one processor is configured to access one or memory devices to control the video content displayed at the one or more displays such as the primary and secondary displays 14, 18.

The PTM 28 provides for communication between one or more gaming devices 10 and the casino system such as the type as hereinafter described. Inasmuch as gaming devices 10 may be manufactured by different entities, mounting like PTMs 28 at each gaming device 10 provides for communication to the system in one or more common message protocols. Typically when a casino enterprise purchases a casino management system they also purchase the same manufacturer's PTMs 28 and video switcher and touch router such as a DM (Display Manager) device or the type sold by Bally Gaming, Inc. of Las Vegas, Nev. which are then installed by the various manufacturers of the gaming devices 10 before delivery. In this manner the mountings for the PTMs 28 on the gaming devices can be configured for location and esthetic appearance. Gaming voucher ticket printer 36 (for printing player cash out tickets) is connected to PIB 208 and GMU 206 over bus lines 222, 224. EGM Processor Board 202, CPU 202, and GMU 206 connect to Ethernet switch 226 over bus lines 228, 230, 232. Ethernet switch 226 connects to a slot management system and a casino management system (SMS, SDS, CMS and CMP) (FIGS. 4A, 4B) network over bus line 234. Ethernet switch 226 may also connect to a server based gaming server or a downloadable gaming server. GMU 206 also may connect to the network over bus line 236. Speakers 26 to produce sounds related to the game or according to the present invention connect through audio mixer and bus lines 240, 242 to EGM Processor Board 202 and PIB 208.

Peripherals 244 connect through bus 246 to EGM Processor Board 202. The peripherals 244 include, but are not limited to the following and may include individual processing capability: bill/voucher acceptor 24 to validate and accept currency and ticket vouchers, the player interfaces such a buttons 20. The peripherals 244 may include the primary game display 14, secondary game display 18 and other displays such as, for example a tertiary video display or touch screen button panel video display as described above. The bill/voucher acceptor 24 is typically connected to the game input-output board of the EGM processing board 202 (which is, in turn, connected to a conventional central processing unit ("CPU") board), such as an Intel Pentium® microprocessor mounted on a gaming motherboard. The I/O board may be connected to CPU processor board by a serial connection such as RS-232 or USB or may be attached to the processor by a bus such as, but not limited to, an ISA bus. The I/O board and/or EGM processing board 202 include outputs for directing processed video content output to the correct display. Intervening graphics processing may also be included. Again these outputs are typically suitable wired connections. The gaming motherboard may be mounted with other conventional components, such as are found on conventional personal computer motherboards, and loaded with a game program which may include a gaming machine operating system (OS), such as a Bally Alpha OS. EGM processor board 202 executes a game program that causes the gaming device 10 to display at the plural displays and play a game. The various components and included devices may be installed with conventionally and/or commercially available components, devices, and circuitry into a conventional and/or commercially available gaming terminal cabinet 12.

When a player has inserted a form of currency such as, for example and without limitation, paper currency, coins or tokens, cashless tickets or vouchers, electronic funds transfers or the like into the currency acceptor, a signal is sent by way of bus 246 to the I/O board and to EGM processor board 202 which, in turn, assigns an appropriate number of credits for play in accordance with the game program. The player may further control the operation of the gaming machine by way of other peripherals 244, for example, to select the amount to wager via the buttons 20. The game starts in response to the player operating a start mechanism such as the handle 34, button 20 such as a SPIN/RESET button or a touch screen icon. The game program includes a random number generator to provide and display randomly selected video indicia at the primary game display 14 as shown in FIG. 1. In some embodiments, the random generator may be physically separate from gaming device 10; for example, it may be part of a central determination host system which provides random game outcomes to the game program. Finally, EGM processor board 202 under control of the game program and OS compares the outcome to an award schedule. The set of possible game outcomes may include a subset of outcomes related to the triggering and play of a feature or bonus game. In the event the displayed outcome is a member of this subset, EGM processor board 202, under control of the game program and by way of I/O Board, may cause feature game play to be presented on the primary game display 14 and/or any legacy secondary display(s) 18.

Video content and predetermined payout amounts for certain outcomes, including feature game outcomes, are stored as part of the game program. Such payout amounts are, in response to instructions from processor board 202, provided to the player in the form of coins, credits or currency via I/O board and a pay mechanism, which may be one or more of a credit meter, a coin hopper, a voucher printer, an electronic funds transfer protocol or any other payout means known or developed in the art.

In various embodiments, game programs (including video content for the plural displays) are stored in a memory device (not shown) connected to or mounted on the gaming motherboard. By way of example, but not by limitation, such memory devices include external memory devices, hard drives, CD-ROMs, DVDs, and flash memory cards. The memory device includes game programs for at least a base game including any associated bonus games. In an embodiment, as described below, the memory may also include a feature program. In an alternative embodiment, the game programs are stored in a remote storage device. In an embodiment, the remote storage device is housed in a remote server such as a downloadable gaming server. The gaming device may access the remote storage device via a network connection, including but not limited to, a local area network connection, a TCP/IP connection, a wireless connection, or any other means for operatively networking components together. Optionally, other data including graphics, sound files and other media data for use with the gaming device are stored in the same or a separate memory device (not shown). Some or all of the game programs and its associated data may be loaded from one memory device into another, for example, from flash memory to random access memory (RAM).

In one or more embodiments, peripherals may be connected to the system over Ethernet connections directly to the appropriate server or tied to the system controller inside the gaming terminal using USB, serial or Ethernet connections. Each of the respective devices may have upgrades to their firmware utilizing these connections.

GMU 206 (Game Monitoring Unit) includes an integrated circuit board and GMU processor and memory including coding for network communications, such as the G2S (game-to-system) protocol from the Gaming Standards Association, Las Vegas, Nev., used for system communications over the network. As shown, GMU 206 may connect to the card reader 32 through bus 248 and may thereby obtain player information and transmit the information over the network through bus 236. Gaming activity information may be transferred by the EGM Processor Board 202 to GMU 206 where the information may be translated into a network protocol, such as S2S, for transmission to a server, such as a player tracking server, where information about a player's playing activity may be stored in a designated server database.

PIB 208 includes an integrated circuit board, PID processor, and memory which includes an operating system, such as Windows CE, a player interface program which may be executable by the PID 208 processor together with various input/output (I/O) drivers for respective devices which connect to PID 208, such as player tracking module 28, and which may further include various games or game components playable on PID 208 or playable on a connected network server and PID 208 is operable as the player interface. PID 208 connects to card reader 32 through bus 218, player tracking display 30 through video decoder 250 and bus 216, such as an LVDS or VGA bus.

As part of its programming, the PID 208 processor executes coding to drive player tracking display 30 and provide messages and information to a player. Touch screen circuitry 252 interactively connects PTM display 30 and video decoder 250 to PID 208 such that a player may input information and causes the information to be transmitted to PID 208 either on the player's initiative or responsive to a query by PID 208. Additionally soft keys 254 connect through bus 212 to PID 208 and operate together with the player tracking display 30 to provide information or queries to a player and receive responses or queries from the player. PID 208, in turn, communicates over the CMS/SMS network through Ethernet switch 226 and busses 230, 234 and with respective servers, such as a player tracking server.

PTMs 28 are linked into the virtual private network of the system components in gaming device 10. The system components include the player tacking module 28 (e.g. Bally iVIEW® device) ('iView" is a registered trademark of Bally Gaming, Inc.) processing board 202 and game monitoring unit (GMU) processing board 202. These system components may connect over a network to the slot management system (such as a commercially available Bally SDS/SMS) and/or casino management system (such as a commercially available Bally CMP/CMS).

The GMU 206 system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to installation on the system components.

The system components include the PTM 28 processing board and game monitoring unit (GMU) 206. The GMU 206 and PTM 28 can be combined into one like the commercially available Bally GTM iVIEW device. This device may have a video mixing technology to mix the EGM processor's video signals with the iVIEW display onto the top box monitor or any monitor on the gaming device.

The PTM 28 may also interface with a switcher and router device of the type described in U.S. Pub. App. 2009/0149253 entitled "Video Switcher and Touch Router Method for a Gaming Machine" filed Jan. 8, 2009 and incorporated by reference. Instead of providing the PTM display 30, the switcher and router device (e.g. DM) provides for the content normally display at the PTM display 30 to be displayed at and share display real estate with one or more of the primary or secondary displays 14, 18.

Figure 3:
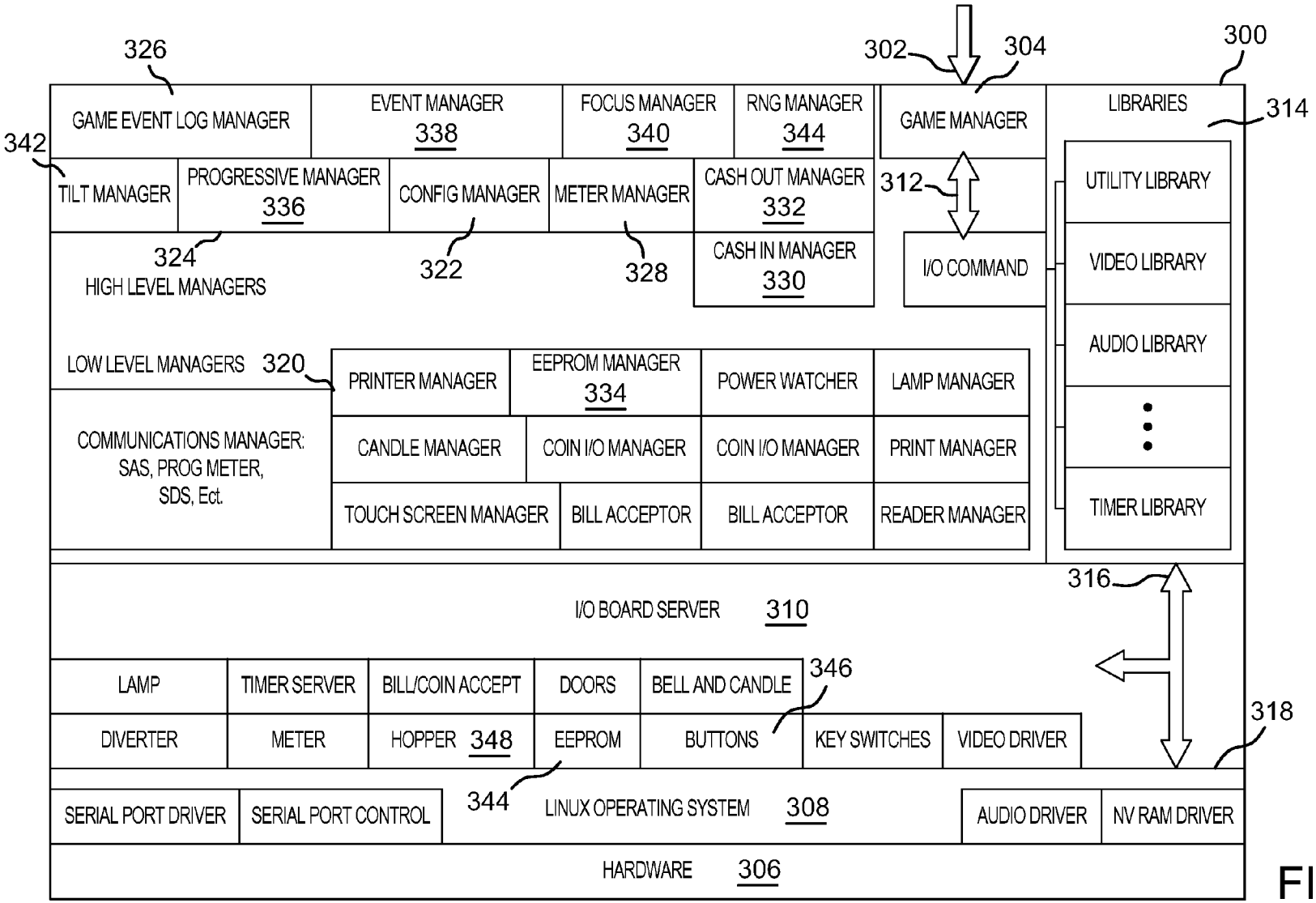
FIG. 3 is a block diagram of the logical components of a gaming kernel for a gaming device.

In accordance with one or more embodiments, FIG. 3 is a functional block diagram of a gaming kernel 300 of a game program under control of gaming terminal processor board 202. The game program uses gaming kernel 300 by calling into application programming interface (API) 302, which is part of game manager 304. The components of game kernel 300 as shown in FIG. 3 are only illustrative, and should not be considered limiting. For example, the number of managers may be changed, additional managers may be added or some managers may be removed without deviating from the scope and spirit of the invention.

As shown in the example, there are three layers: a hardware layer 306; an operating system layer 308, such as, but not limited to, Linux; and a game kernel layer having game manager 304 therein. In one or more embodiments, the use of an operating system layer 308, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel 300 executes at the user level of the operating system layer 308, and itself contains a major component called the I/O board server 310. To properly set the bounds of game application software (making integrity checking easier), all game applications interact with gaming kernel 300 using a single API 302 in game manager 304. This enables game applications to make use of a well-defined, consistent interface, as well as making access points to gaming kernel 300 controlled, where overall access is controlled using separate processes.

For example, game manager 304 parses an incoming command stream and, when a command dealing with I/O comes in (arrow 312), the command is sent to an applicable library routine 314. Library routine 314 decides what it needs from a device, and sends commands to I/O board server 310 (see arrow 316). A few specific drivers remain in operating system layer 308's kernel, shown as those below line 318. These are built-in, primitive, or privileged drivers that are (i) general (ii) kept to a minimum and (iii) are easier to leave than extract. In such cases, the low-level communications is handled within operating system layer 308 and the contents passed to library routines 314.

Thus, in a few cases library routines may interact with drivers inside operating system layer 308, which is why arrow 316 is shown as having three directions (between library routines 314 and I/O board server 310, or between library routines 314 and certain drivers in operating system layer 308). No matter which path is taken, the logic needed to work with each device is coded into modules in the user layer of the diagram. Operating board server 310 layer is kept as simple, stripped down, and common across as many hardware platforms as possible. The library utilities and user-level drivers change as dictated by the game cabinet or game machine in which it will run. Thus, each game cabinet or game machine may have an industry standard EGM processing board 202 connected to a unique, relatively dumb, and as inexpensive as possible I/O adapter board, plus a gaming kernel 300 which will have the game-machine-unique library routines and I/O board server 310 components needed to enable game applications to interact with the gaming machine cabinet. Note that these differences are invisible to the game application software with the exception of certain functional differences (i.e., if a gaming cabinet has stereo sound, the game application will be able make use of API 302 to use the capability over that of a cabinet having traditional monaural sound).

Game manager 304 provides an interface into game kernel 300, providing consistent, predictable, and backwards compatible calling methods, syntax, and capabilities by way of game application API 302. This enables the game developer to be free of dealing directly with the hardware, including the freedom to not have to deal with low-level drivers as well as the freedom to not have to program lower level managers 320, although lower level managers 320 may be accessible through game manager 304's interface if a programmer has the need. In addition to the freedom derived from not having to deal with the hardware level drivers and the freedom of having consistent, callable, object-oriented interfaces to software managers of those components (drivers), game manager 304 provides access to a set of upper level managers 324 also having the advantages of consistent callable, object-oriented interfaces, and further providing the types and kinds of base functionality required in casino-type games. Game manager 304, providing all the advantages of its consistent and richly functional game application API 302 as supported by the rest of game kernel 300, thus provides a game developer with a multitude of advantages.

Game manager 304 may have several objects within itself, including an initialization object (not shown). The initialization object performs the initialization of the entire game machine, including other objects, after game manager 304 has started its internal objects and servers in appropriate order. In order to carry out this function, the kernel's configuration manager 322 is among the first objects to be started; configuration manager 322 has data needed to initialize and correctly configure other objects or servers.

The upper level managers 324 of game kernel 300 may include game event log manager 326 which provides, at the least, a logging or logger base class, enabling other logging objects to be derived from this base object. The logger object is a generic logger; that is, it is not aware of the contents of logged messages and events. The game event log manager's 326 job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 328 manages the various meters embodied in the game kernel 300. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 328 receives its initialization data for the meters, during start-up, from configuration manager 322. While running, the cash in manager 330 and cash out manager 332 call the meter manager's 328 update functions to update the meters. Meter manager 328 will, on occasion, create backup copies of the soft meters by storing the soft meters' readings in EEPROM. This is accomplished by calling and using EEPROM manager 334.

In accordance with still other embodiments, progressive manager 336 manages progressive games playable from the game machine. Thus where the progressive is a WAN-based progressive the progressive controller 2000 may be incorporated into the progressive manager 336. Event manager 338 is generic, like game event log manager 326, and is used to manage various gaming machine events. Focus manager 340 correlates which process has control of various focus items. Tilt manager 342 is an object that receives a list of errors (if any) from configuration manager 322 at initialization, and during game play from processes, managers, drivers, etc. that may generate errors. Random number generator manager 344 is provided to allow easy programming access to a random number generator (RNG), as a RNG is required in virtually all casino-style (gambling) games. Random number generator manager 344 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 332 has the responsibility of configuring and managing monetary output devices. During initialization, cash out manager 332, using data from configuration manager 322, sets the cash out devices correctly and selects any selectable cash out denominations. During play, a game application may post a cash out event through the event manager 338 (the same way all events are handled), and using a call back posted by cash out manager 332, cash out manager 332 is informed of the event. Cash out manager 332 updates the credit object, updates its state in non-volatile memory, and sends an appropriate control message to the device manager that corresponds to the dispensing device. As the device dispenses dispensable media, there will typically be event messages being sent back and forth between the device and cash out manager 332 until the dispensing finishes, after which cash out manager 332, having updated the credit manager and any other game state (such as some associated with meter manager 328) that needs to be updated for this set of actions, sends a cash out completion event to event manager 338 and to the game application thereby. Cash in manager 330 functions similarly to cash out manager 332, only controlling, interfacing with, and taking care of actions associated with cashing in events, cash in devices, and associated meters and crediting.

In a further example, in accordance with one or more embodiments, I/O board server 310 may write data to the gaming machine EEPROM memory, which is located in the gaming machine cabinet and holds meter storage that must be kept even in the event of power failure. Game manager 304 calls the I/O library functions to write data to the EEPROM. The I/O board server 310 receives the request and starts a low priority EEPROM manager 334 thread within I/O board server 310 to write the data. This thread uses a sequence of 8 bit command and data writes to the EEPROM device to write the appropriate data in the proper location within the device. Any errors detected will be sent as IPC messages to game manager 304. All of this processing is asynchronous.

In accordance with one embodiment, button module 346 within I/O board server 310, polls (or is sent) the state of buttons every 2 ms. These inputs are debounced by keeping a history of input samples. Certain sequences of samples are required to detect a button was pressed, in which case the I/O board server 310 sends an inter-process communication event to game manager 304 that a button was pressed or released. In some embodiments, the gaming machine may have intelligent distributed I/O which debounces the buttons, in which case button module 346 may be able to communicate with the remote intelligent button processor to get the button events and simply relay them to game manager 304 via IPC messages. In still another embodiment, the I/O library may be used for pay out requests from the game application. For example, hopper module 348 must start the hopper motor, constantly monitor the coin sensing lines of the hopper, debounce them, and send an IPC message to the game manager 304 when each coin is paid.

Further details, including disclosure of lower level fault handling and/or processing, are included in U.S. Pat. No. 7,351,151 issued Apr. 1, 2008 entitled "Gaming Board Set and Gaming Kernel for Game Cabinets" the disclosure of which is incorporated herein by explicit reference.

Figure 4A:
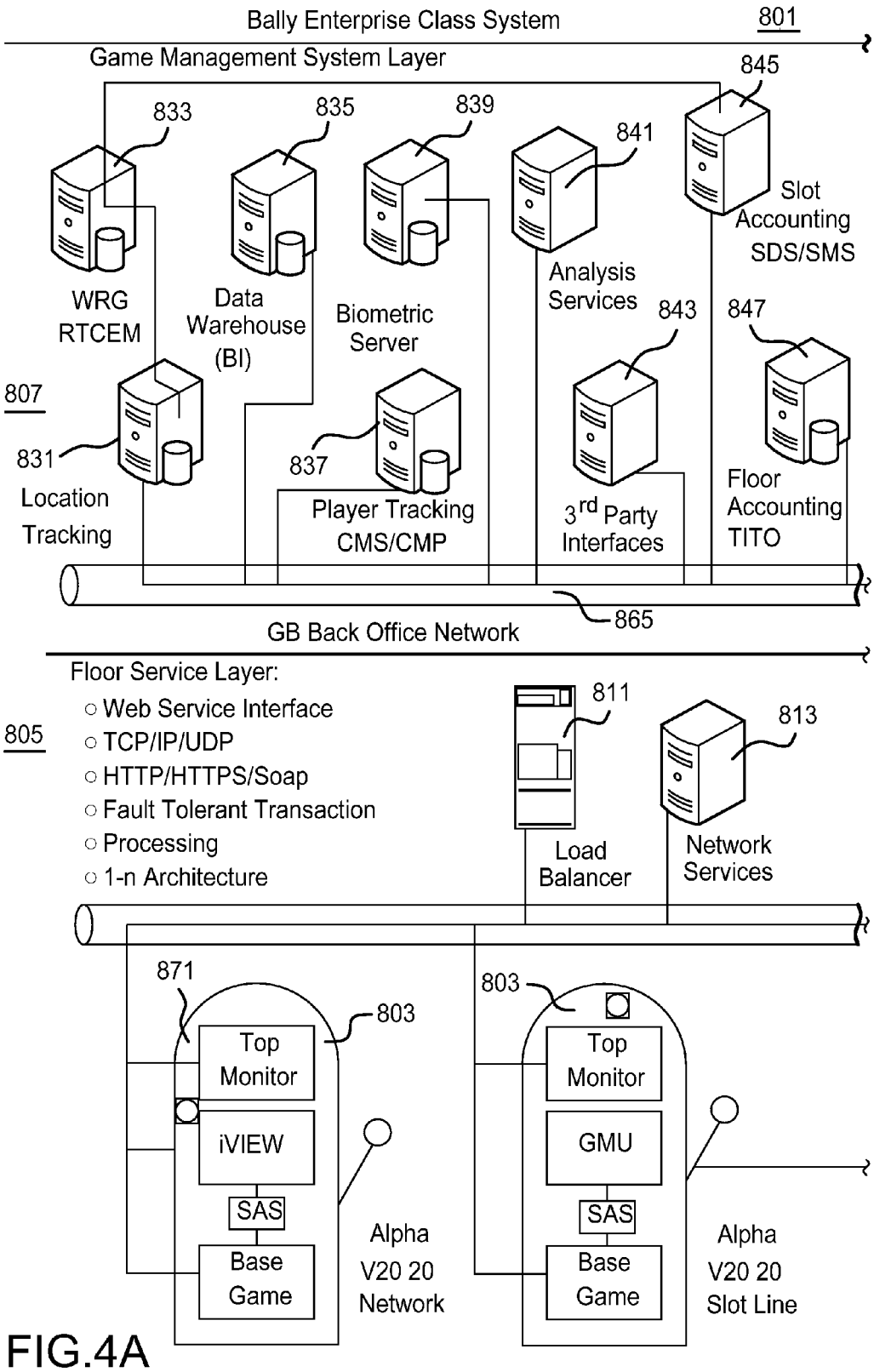
FIGS. 4A and 4B is a schematic of an example of a casino enterprise network incorporating gaming devices.

Referring to FIGS. 4A and B, an example of a gaming system 801 is shown in accordance with one or more embodiments. Gaming system 801 may include one casino or multiple locations (herein referred to collectively as a casino enterprise) and generally includes a network of gaming devices 803 (including gaming devices 10 of the type as described in FIG. 1), floor management system (SMS) 805, and casino management system (CMS) 807. SMS 805 may include load balancer 811, network services server 813, player tracking module 28, iView (PTM 28) content servers 815, certificate services server 817, floor radio dispatch receiver/transmitters (RDC) 819, floor transaction servers 821 and game engines 823 (where the gaming devices 803 operate server based or downloadable games), each of which may connect over network bus 825 to gaming devices 803. CMS 807 may include location tracking server 831, WRG RTCEM (William Ryan Group Real Time Customer Experience Management from William Ryan Group, Inc. of Sea Girt, N.J.) server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming devices 803. The various servers and gaming devices 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming devices 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

The gaming devices 803 include various peripheral components that may be connected with USB, serial, parallel, RS-485 or Ethernet devices/architectures to the system components within the respective gaming machine. The GMU 507 (shown as GMU 206 in FIG. 2A) has a connection to the base game through a serial SAS connection. The system components in the gaming cabinet may be connected to the servers using HTTPs or G2S protocols over Ethernet. Using CMS 807 and/or SMS 805 servers and devices, firmware, media, operating systems, and configurations may be downloaded to the system components of respective gaming devices for upgrading or managing floor content and offerings in accordance with operator selections or automatically depending upon CMS 807 and SMS 805 master programming. The data and programming updates to gaming devices 803 are authenticated using conventional techniques prior to install on the system components.

In various embodiments, any of the gaming devices 803 may be a mechanical reel spinning slot machine, video slot machine, video poker machine, video Bingo machine, Keno machine, or a gaming device offering one or more of the above described games including an interactive wheel feature. Alternately, gaming devices 803 may provide a game with an accumulation-style feature game as one of a set of multiple primary games selected for play by a random number generator, as described above. A gaming system 801 of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. Published Application 2008/0139305, entitled "Networked System and Method for Group Gaming," filed on Nov. 9, 2007, which is hereby incorporated by reference in its entirety for all purposes.

The gaming system 801, among other functionalities such as slot accounting (i.e. monitoring the amount wagered ("drop"), awards paid) and other casino services, includes the player tracking CMS/CMP server 837 and/or data warehouse 835 storing player account data. This data includes personal data for players enrolled in the casino players club sometimes referred to as a loyalty club. An example of the personal data is the player's name, address, SSN, birth date, spouse's name and perhaps personal preferences such as types of games, preferences regarding promotions, player rating level, available player comp points (points accumulated based upon commercial "spend" activity with the enterprise including gaming and which may be redeemed or converted into cash or merchandise) and the like. As is known in the industry and according to the prior art, at enrolment the player is assigned a created account in the player tracking CMS/CMP server 837 and is issued a player tracking card having a machine readable magnetic stripe.

The system 801 may also include electronic transfer of funds functionality. For example, a player having accumulated $100 at a gaming terminal 10 may decide to "cash out"

to play another gaming terminal 10. The player, for example using the PTM 28 to initiate communication with the system 801 for example server 837 to upload the value from the gaming terminal 10 into an electronic account associated with the player's account. The player may choose to upload all or a portion of the funds the player's established electronic account. The system would prompt the player to enter their PIN (or obtain biometrical confirmation as to the player's identity) and upload the chosen amount to their account. When the player moves to another gaming terminal 10 he/she inserts their player loyalty card into the card reader 32 to access their account. A prompt provides for the player to request funds from their account. Entering their PIN (or biometric identifier) the player can input the desired amount which is downloaded to their gaming terminal 10 for play.

Figure 5:
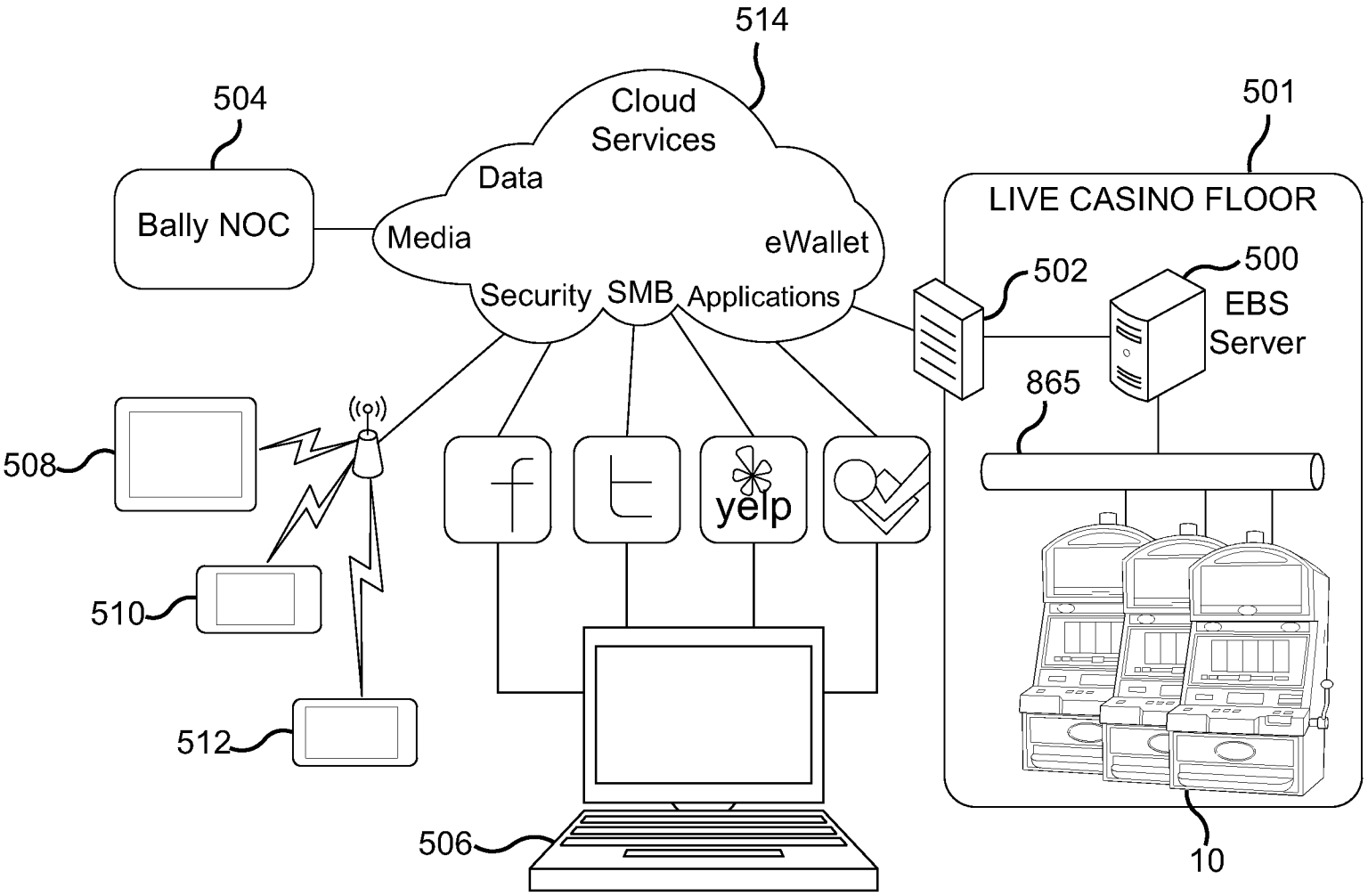
FIG. 5 is a diagram showing an example of an architecture for tying a casino enterprise network to an external provider of games and content to Internet or broadband communication capable devices.

The present invention may be implemented or promoted by or through a system as suggested in FIG. 5. At 501 is the gaming enterprise system which may be hosted at a casino property enterprise, across several casino enterprises or by a third party host. As described above the gaming enterprise system 501 has a network communication bus 865 providing for communication between the gaming devices 10 and various servers as described above with respect to FIGS. 4A,B. To provide the functionality illustrated in FIG. 5, a feature server 500, such as a Bally Elite Bonusing Server, is connected to the network communication bus 865 for communication to the gaming system 801, the gaming devices 10 and the various servers and other devices as described above. Through a secure network firewall 502 the feature server 500 is in communication with a cloud computing/storage service 514 which may be hosted by the casino enterprise, a licensed third party or if permitted by gaming regulators an unlicensed provider. For example the cloud service 514 may be as provided by Microsoft® Private Cloud Solutions offered by Microsoft Corp. of Redmond, Wash., USA. The cloud service 514 provides various applications which can be accessed and delivered to, for example, personal computers 506, portable computing devices such as computer tablets 508, personal digital assistants (PDAs) 510 and cellular devices such as telephones and smart phones 512. For example the cloud service 514 may provide and support the enterprise applications in association with the feature server 500. The cloud service 513 may also facilitate the delivery of content to user/players by supporting updates and advertising through the enterprise applications to the remote device user/player. The cloud service 514 includes security provide for secure communication with the cloud service 514 between the player/users and the cloud service 514 and between the cloud service 514 and the gaming enterprise system 501. Security applications may be through encryption, the use of personal identification numbers (PINS), biometric identification, location determination or other devices and systems. As suggested in FIG. 5 the cloud service 515 stores or accesses player/user data retrieved from players/users and from the gaming enterprise system 501 and feature server 500.

The players/users may access the cloud service 514 and the applications and data provided thereby through the Internet or through broadband wireless cellular communication systems and any intervening sort range wireless communication such as Wi-Fi. The players/users may access the applications and data through various social media offerings such as Facebook, Twitter, Yelp, MySpace or LinkedIn or the like.

The cloud service 514 may also host game applications to provide virtual instances of games and features, such as described herein, for free, promotional, or where permitted, P2P (Pay to Play) supported gaming Third party developers may also have access to placing applications with the cloud service 514 through, for example a national operations center (Bally NOC 504). A game software manufacturer such as Bally Gaming, Inc. may also provide game applications on its own or on behalf of the casino enterprise.

Other media such as advertising, notices (such as an upcoming tournament) promotions and surveys may also be provided to and through the cloud service 514. When a player/user accesses the cloud service 514 certain media may be delivered to the player/user in a manner formatted for their application and device.

The cloud service 514 enables the casino enterprise to provide base games and features and to market to and foster player loyalty. To drive such interaction various incentive programs may be employed including, as described above, users earning or being awarded mystery game chances which may be redeemed at their next visit to the casino enterprise or, where permitted, during play on their remote devices.

According to the present invention a progressive jackpot pool P is provided. Preferably the progressive jackpot pool P is a jackpot which is funded from the wagers of the base game such as by assigning a percentage of each qualifying base game wager to the jackpot. It should be understood that the progressive jackpot pool could be funded additionally or alternatively from other sources such marketing dollars (i.e. from the provider's revenue), third party funding or a combination of several of the foregoing sources. As but an example a casino enterprise may provide initial funding for a progressive jackpot pool P from marketing dollars and then "progress" the jackpot with both marketing and a share of the wagers from qualifying gaming devices 10. The progressive jackpot pool P preferably has a starting, or minimum value $V_{Min}$. The progressive jackpot pool P may also have a maximum value $V_{Max}$ or alternative will simply grow until won. As an example for purposes of explanation only $V_{Min}$ may be $10 and $V_{Max}$ may be $20. Where a percentage of the wagers are used to aggregate the jackpot pool P this percentage may include amounts necessary to seed the starting value, e.g. $10 for the next jackpot pool P.

The progressive pool may also be a virtual value such as credits where the underlying play is not P2P, i.e. play for fun and not money. This virtual pool could be increased based upon, for example, the amount of play, a percentage of virtual value wagered, time, advertising impressions delivered or the like.

The progressive jackpot pool P may be a standalone progressive. This type of progressive is confined to a single gaming device 10. The progressive jackpot pool P may be a LAN (local area network)-based progressive played among one or several banks of gaming devices 10. For example a LAN based progressive may link ten gaming devices 10 together to contribute to the progressive and to play for the progressive. A LAN-based progressive typically includes a processor controlled local jackpot controller (for example a progressive jackpot controller 2000 installed in the cabinet of one of the linked gaming devices 10) which amasses the progressive jackpot pool P, determines when an award of at least a portion of the jackpot is triggered and determines the jackpot value PV to be awarded. Cava, US Pub App 2009/0117972 published May 7, 2009 and titled "Systems and/or Methods for Distributing Bonus Rewards Based on Accumulated Gaming Device Wins" the disclosure of which is incorporated by reference discloses a LAN-based jackpot controller. The progressive jackpot pool P may also be a WAN (wide area)-based progressive for example linking all or many of the gaming devices 10 across one or more casino floors. Acres et al U.S. Reissued patent RE38,812 incorporated by reference discloses an example of a WAN-based (sometimes referred to herein as a systems-based) progressive jackpot. For a wager-funded progressive it can be appreciated that LAN and WAN based progressives grow faster and, if a trigger is so designed, to a large $V_{Max}$. Where the system is, for example, operated in an Internet environment participating devices can be identified and linked to the progressive.

All or a portion of the progressive jackpot pool P is awarded upon satisfaction of a trigger condition. The trigger condition may be predefined, randomly defined or pseudo-randomly defined. According to the present invention and since the progressive prize is a mystery prize, the trigger is not satisfied by any symbol combination on the base game. While base game symbol driven progressive jackpots are well known, inclusion of such progressives must be accounted for in the base game math. Thus such progressive jackpots cannot be added to base games without (1) reconfiguring the base game to account for the odds of a symbol combination triggering the progressive and the theoretical payout or (2) requiring a separate progressive jackpot wager. Where the underlying games are played on a free, entertainment only basis, reconfiguration of the base games is not required since there is there is no financial risk to the host associated with the free play.

Preferably the progressive jackpot trigger according to the present invention may be any mystery trigger condition. For example, the trigger condition may be an nth coin-in trigger where when the contributions cause the progressive jackpot to achieve a random trigger value, the jackpot is awarded. Acres et al U.S. Reissued patent RE38,812 incorporated by reference discloses such as type of trigger. The trigger may also be arranged to be a virtual lottery such as described in Olive, U.S. Pat. No. 7,108,603 issued Sep. 19, 2006 and titled "Slot Machine Game and System with Improved Jackpot Feature" and Torango, U.S. Pat. No. 6,592,460 issued Jul. 15, 2003 and titled "Progressive Wagering System" the disclosures of which are incorporated by reference.

Figure 9:
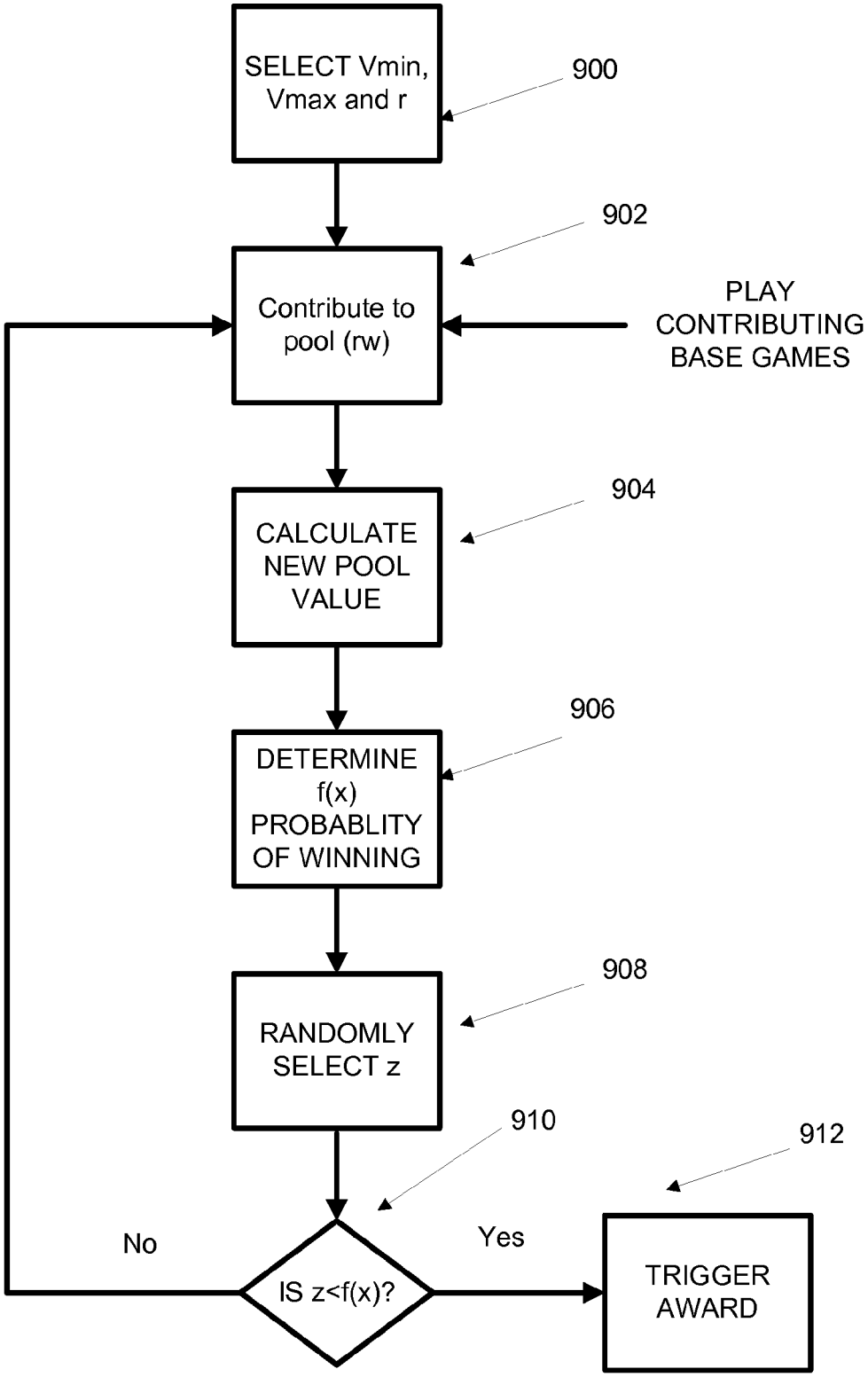
FIG. 9 is a logic diagram showing a process of an embodiment for determining if a trigger condition is satisfied for issuing an award.
Figure 10:
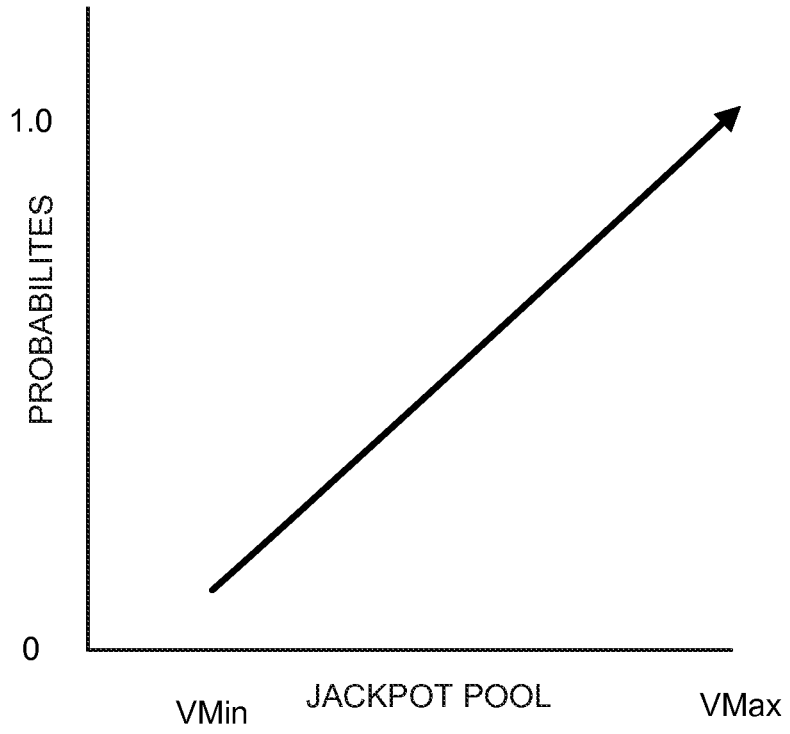
FIG. 10 is a graph showing the relationship between a progressive pool maximum value ($V_{Max}$) versus the probabilities for triggering the jackpot according to the process of FIG. 9.

The trigger may also be a random trigger where the odds of the trigger occurring increase from a minimum at $V_{Min}$ (odds still greater than 0) toward unity as the progressive jackpot $P \rightarrow V_{Max}$ In this fashion the trigger is guaranteed to occur at a jackpot P value not greater than $V_{Max}$. FIGS. 9 and 10 and the Appendix attached hereto and incorporated by reference described below sets forth such a trigger.

Figure 4B:
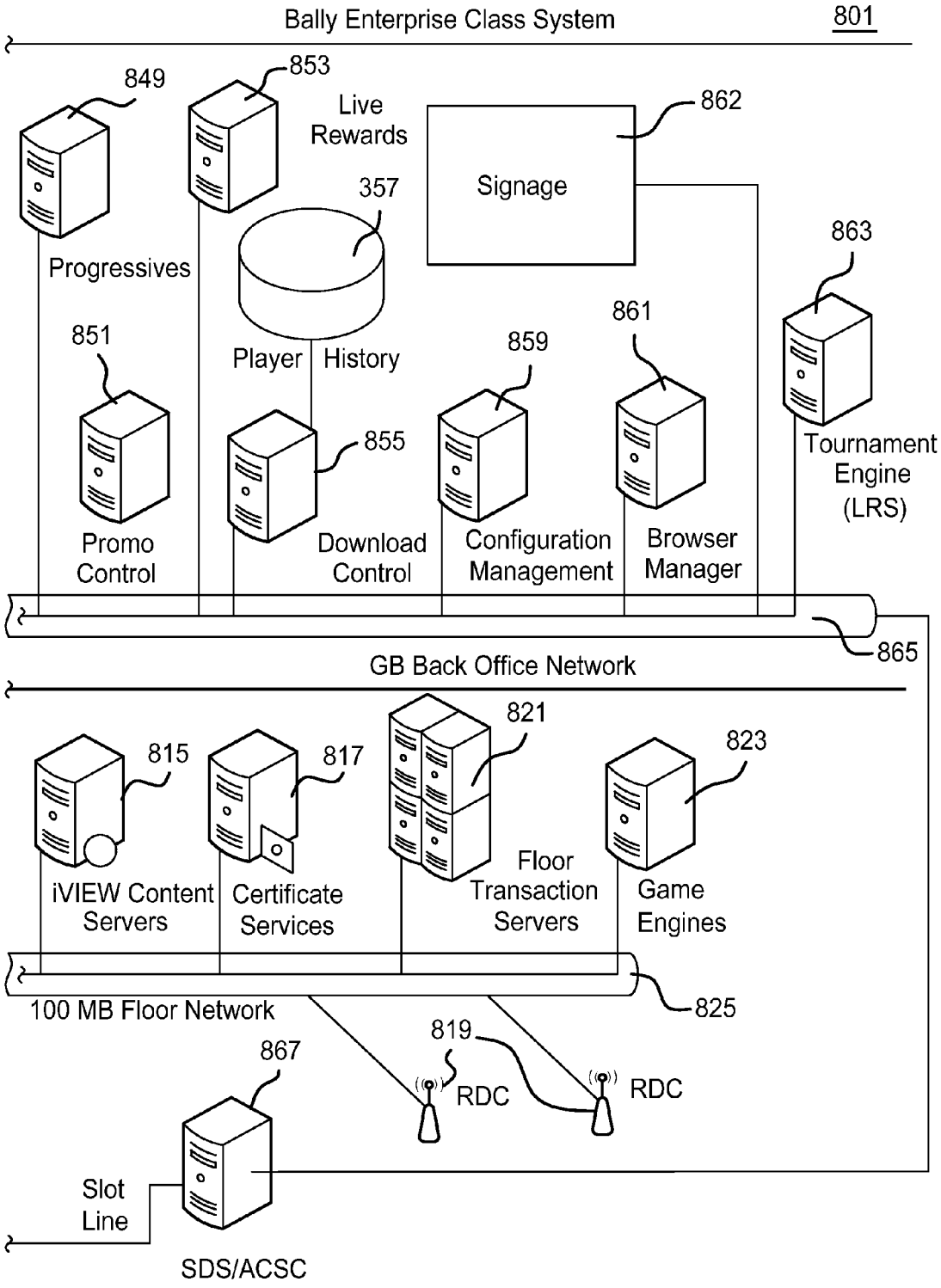

According to the present invention the game CPU 202 and/or progressive jackpot controller 2000 is/are configured to accrue the progressive jackpot pool P and to provide a mystery jackpot trigger. The progressive jackpot controller 2000 may be of the type described above and where a WAN-based progressive controller 2000 may be included in the progressive server 849 (FIG. 4B).

Figure 6:
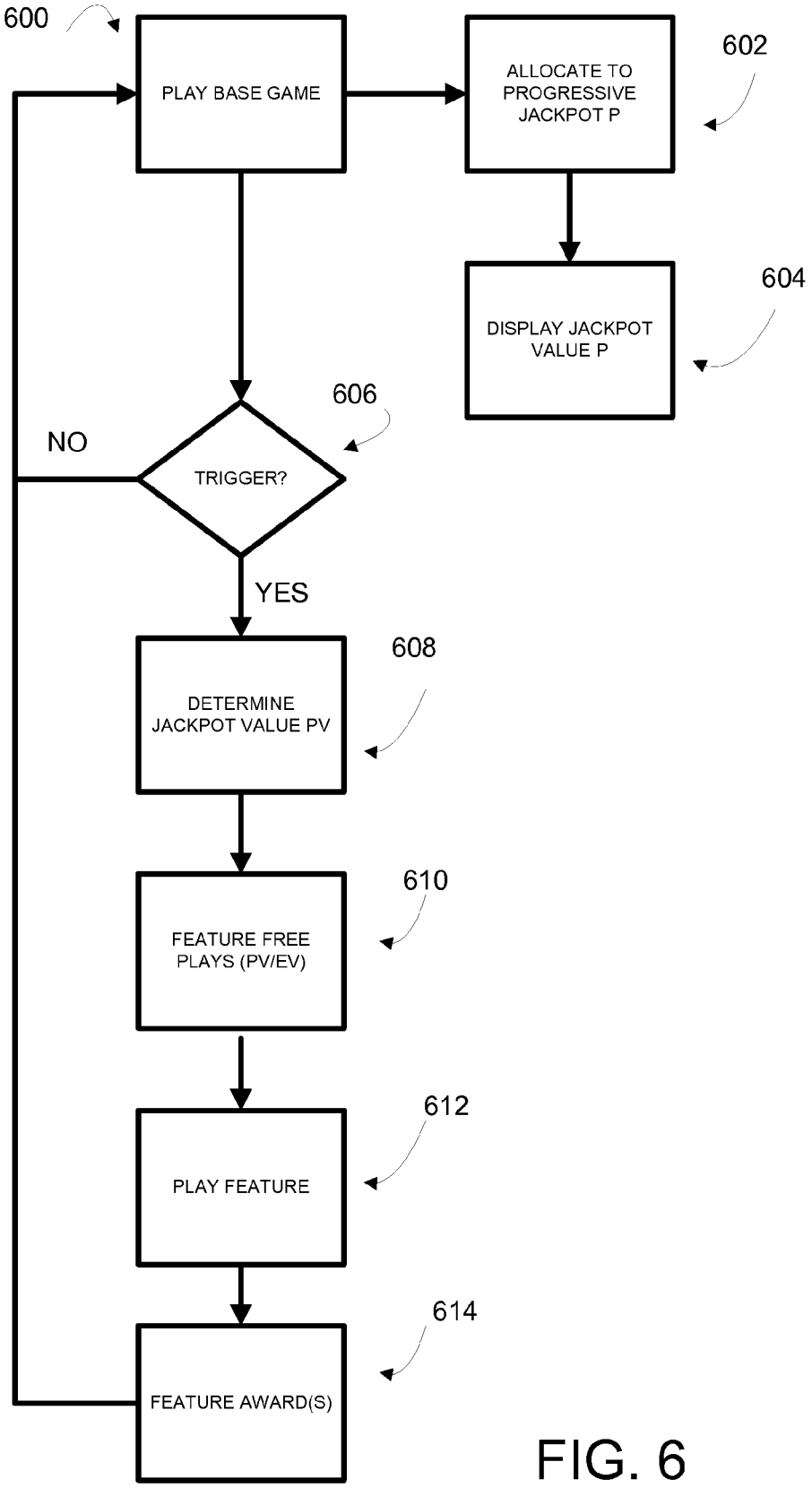
FIG. 6 illustrates is a logic diagram showing the process steps for implementing an embodiment of the present invention.

Turning to FIG. 6 the operation of an embodiment of the present invention will be described in connection. At 600 the player plays the base game by making value wagers (P2P gaming) or by wagering fictitious credits. Based upon the wagers at 602 a percentage of the value is allocated to a progressive jackpot pool P. As stated above the progressive jackpot pool P may have at least a minimum value $V_{Min}$. In the example given above $V_{Min}$=$10. At 604 the then current progressive jackpot value may be displayed at, for example, the secondary display 18 or where the progressive is a systems controlled jackpot at the PTM display 30 or in a window created at the primary display 14. Preferably, however, the pool value in currency is not displayed inasmuch as the present invention as configured may award more or less than a displayed jackpot value. There may be displayed a range of awards such as a message "Win a Progressive Jackpot Between $10 and $20". At 606 a determination is made if a feature trigger condition is satisfied. If not, the progressive is not triggered and play of the base game at 600 continues. If at 606 the progressive jackpot is triggered at 608 the game CPU 202 and/or progressive controller 2000 determines the then current progressive jackpot value PV. In this example PV may be $17.32. At 610 a number of feature free plays is determined based upon PV/EV where EV is the expected value of a free game play. Expected Value (EV)=wager+(expected (theoretical) win−expected loss). For example if a player were to wager $1 on the flipping of a coin where each side, heads or tails, has theoretical odds of 50% (0.5) of occurring and if the player were awarded $1 for each winning bet and would lose the $1 bet for a losing wager, the EV would be as follows:

$$EV=\$1+((0.5\times\$1)-(0.5\times\$1))=1.0$$

In an embodiment the free play feature described herein may only be available where the player makes a required level of wager, e.g. a maximum base game wager of $1. If the player wagers $0.50 for the base game they would not be eligible for the feature. Alternatively the player may be required to make one or both of a maximum wager or separate wager in the base game to be eligible for the feature. Thus in this example, where PV is $17.32 and EV=$1, the player would be awarded 17.32 free plays. The fractional remainder (R) of 0.32 free plays may be handled by one or more techniques. In one embodiment R is ignored and only the integer component amount of the free spins, 17 in this example, is awarded. The number of free games can thus be rounded off to a nearest integer (either up or down). At 612 one or more of the game CPU 202 and/or progressive controller 2000 controls the primary display 14 or display 17 free plays of a feature game. The feature game may be a spinning reel slot machine game, roulette-type of game, a spinning wheel, a flip a coin game, a pick a hidden prize game, or other type of game resulting in outcomes. The feature game may be free plays of the base game or may be free plays of a different game or a combination of the two. For example where PV=$17.32 and the base game has an EV of 0.9 the number of free plays would be calculated based upon the base game EV. Where there is a different game having an EV of $1, a first portion of the PV (for example $10) may be free plays of the base game and the remaining $7.32 as free plays of the different game. In an embodiment the free plays are displayed serially, one after the other, but in another embodiment all or a portion of the free plays may be displayed simultaneously to increase the speed of play of the free game feature, e.g. 17 hands of stud poker displayed simultaneously.

Each feature free play results in an outcome. In an embodiment each outcome may one of a losing or winning outcome. Winning outcomes may have various awards, such as in a slot machine game, or each winning award may have the same award value. In another embodiment each free play may result in a winning outcome whose values have a range so long as for each free play the EV is substantially equal to the desired EV. In this regard it should be noted that EV can have some variance from the target EV (in this example $1). For example EV used in the calculation may be $1 as in the example given; but the true EV may be 0.98 or 1.02.

At 614 any awards from the feature free plays are awarded to the player. A meter at the gaming device 10 displays the awards. A free play meter may also be provided to display to the player the number of free plays awarded and to decrement the number as free plays are conducted. When all free plays have been concluded, the feature is ended and the process returns to the player playing the base game.

Because the EV is used to determine the number of free plays, theoretically the player should be awarded the full value of PV through the feature. In reality the player may win more or less than PV during the free play session. If the player wins more, that amount is awarded to the player and is deducted from the progressive pool P. If the player wins less than PV and surplus is retained in the progressive jackpot pool P.

Figure 7:
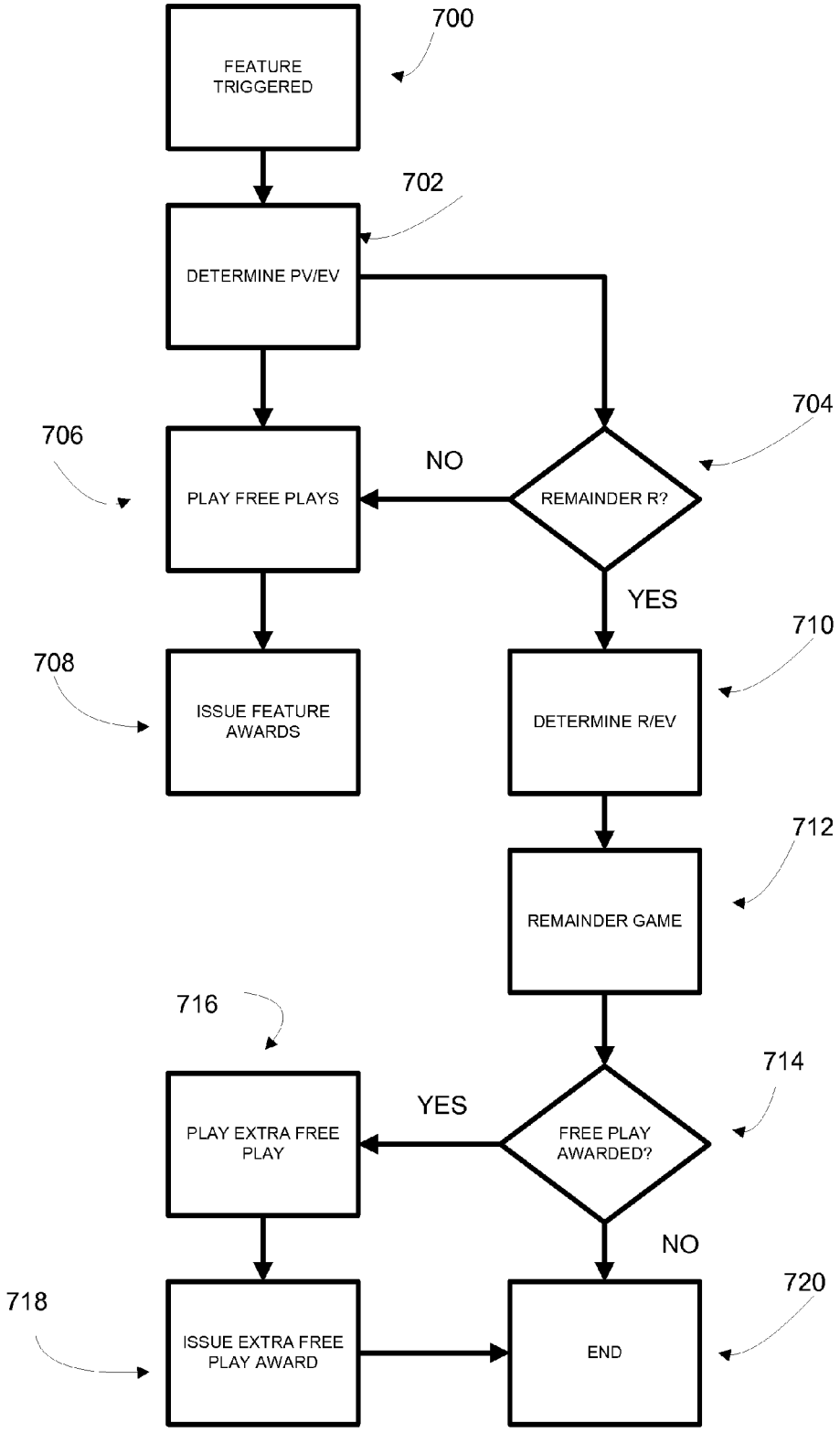
FIG. 7 is a logic diagram showing the process steps for implementing an embodiment of the present invention.

FIG. 7 illustrates an embodiment where the remainder R from PV/EV can be accounted for rather than rounding up or down to the next integer free play. At 700 the feature is triggered in a manner as described above and at 702, also as described above, PV/EV is determined. At 706 the integer number of free plays (17 free plays in the example) regardless of the presence of the remainder R is conducted resulting in the award at 708. If at 704 there is a remainder R (in the above example 0.32) at 710 one or more of the CPU 202 and/or progressive controller 2000 determines R/EV. In the present example this algorithm results in a number 0.32/$1=0.32. To account for the fractional free game represented by the remainder a remainder game is conducted having odds of 0.32:1=a 32% chance of producing a winning outcome. The game may the spin of a virtual reel or wheel displayed at the primary display 14 configured to have a 32% chance of a winning outcome, a selection game where the player selects from hidden outcomes or other games. The remainder game may or may not be displayed to the player such as by conducting a hidden lottery where the chances of winning are R/EV. For example, the lottery may have a draw field of the numbers 1-100 and the player has assigned the numbers 1-(Rx100). Thus in the example the player would have, in the virtual lottery, the numbers 1-32 where R=0.32. At 712 the remainder game is played to produce an outcome. At 714 the process includes determining if the remainder game outcome is a winning or losing outcome. If the remainder game has a winning outcome, at 716 the player is awarded an extra feature free play at 716 and if the free play results in a winning outcome at 718 the player is issued the resulting award. If the player from the remainder game has a losing outcome at 714 no extra feature free play is awarded and at 720 the feature ends.

Figure 8:
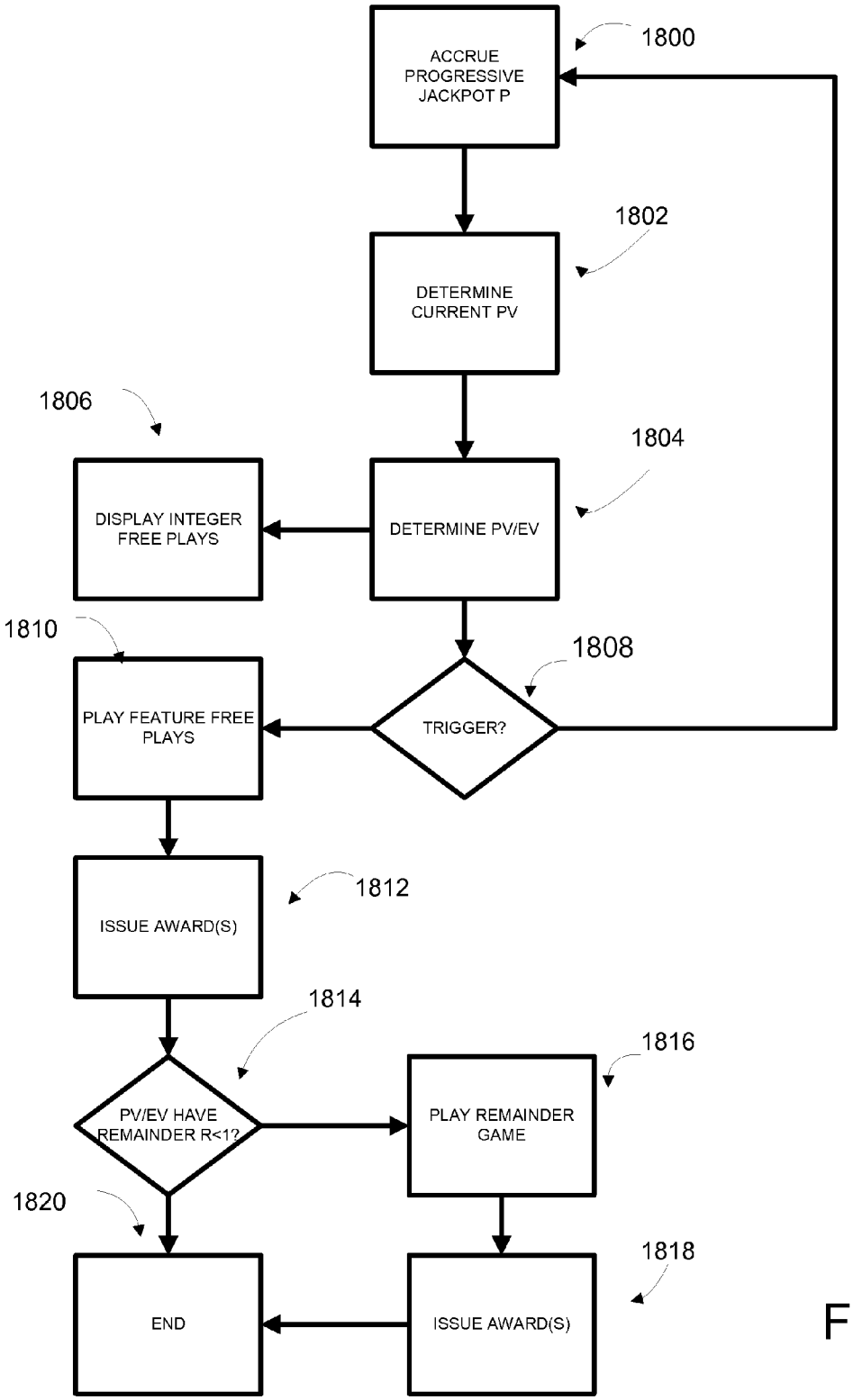
FIG. 8 is a logic diagram showing the process steps for implementing an alternate embodiment of the present invention.

FIG. 8 shows another embodiment where the determination of PV/EV is conducted routinely prior to the feature of the trigger condition to display to the player(s) the number of feature free plays thus far earned as the progressive jackpot pool P grows. At 1800 the progressive jackpot pool P is accrued as described above. One or more of the CPU 202 and/or progressive controller 2000 at 1802 determines the current PV. The PV may be the current value of P. The PV may be different where, for example, only a portion of the pool P will be awarded upon a triggering condition. At 1806 one or more of the CPU 202 and/or progressive controller 2000 controls the display at the game device(s) 10 and/or a large, bank display (not shown) of the then current integer value from PV/EV (i.e. if the jackpot is trigger now this is the number of free plays awarded). In the example above where PV=$17.32 the display would show, for example, "17 Progressive Jackpot Free Games Earned". The process at 1808 also determines whether the feature trigger condition has been satisfied. If not the routine returns to the accumulating of the progressive jackpot P at 1800. As the jackpot pool P grows eventually the current PV/EV will reach a level to increase the number of free game, e.g. 18 free games. If, however, the trigger condition is satisfied at 1808 at 1801 the allotted integer free feature plays (in this example 17 free plays) are played at 1810 and any awards there from are issued at 1812. The routine, as described above also determines at 1814 if the algorithm PV/EV has any non-integer remainder R (R=0.32 in the example) and if so at 1816 plays the remainder game to determine if an additional feature free play will be awarded. If an additional feature free play is awarded the free play is conducted of the game having the EV and any award there form is issued at 1818. At 1820 the feature routine is ended and the process returns to 1800. If at 1814 it is determined that there is no remainder R the feature ends at 1820 and the process returns to 1800.

As can be appreciated the process illustrated in FIGS. 7 and 8 and described above accounts for any fractional remainder R from the determination PV/EV. Further the expected amount of the progressive jackpot PV is awarded through the series of feature free plays. However, as stated above, since the number of feature free plays has expected values theoretically determined it can be seen the player may receive more or less than PV during the feature free plays. In the example given above where PV is $17.32 the player may actually win $19.00 or $16.50 depending upon the outcomes and awards from the feature free play games. But theoretically, over numerous plays of the feature, the sum of the awards should be substantially equal to the PV.

As stated above the features of the present invention may be incorporated and used in connection with P2P games. Also for novelty, or entertainment only style games, the features may also be used where virtual, valueless credits may be wagered and virtual, valueless, awards given.

Turning to the Appendix and FIGS. 9 and 10 an example of a mystery jackpot trigger according to an embodiment of the present invention is shown. At 900 the operator for the progressive jackpot selects the values of $V_{Min}$, $V_{Max}$ and r where $V_{Min}$ is the minimum value of the jackpot pool (such as the rest value after the progressive pool has been won), $V_{Max}$ is the desired maximum value of the pool by which the award must be issued and r is the pool contribution percentage from each wager w in the contributing base games. For example, $V_{Min}$ may be $10, $V_{Max}$ may be $20 and r may be 2%. These numbers as from the example above. It should be understood that the values may be much higher where, for example, the trigger is used for a WAN-based progressive having dozens if not hundreds of contributing gaming machines. At 902 one or more of the game CPU 202 and progressive controller 2000 monitors the wagers w at the contributing gaming devices and contributes rw (e.g. 0.02w in the example) to the pool and at 904 the new pool value PV is calculated for each contribution rw. Thus as each contribution rw is received, from the Appendix, at 906 the new probability of triggering (winning) the progressive is determined from the function f(x). As shown in the graph of FIG. 10 f(x) leads to an arrangement where the probabilities for triggering the jackpot increase from a small value (>0) to 1 as the pool increments toward $V_{Max}$. Should the pool reach $V_{Max}$ the probabilities are 1 and the jackpot must be triggered when the last contribution of rw is contributed. After determining the probabilities f(x) as each contribution is received at 908 one or more of the CPU 202 and progressive controller 2000 randomly selects a number z where $0 \leq z < 1$. If at 910 $z < f(x)$ then the award is triggered at 912. If not, the process returns to 902 to make the calculation for the next contribution.

Regardless of the mystery trigger mechanism, upon a trigger condition either the gaming device 10 whose contribution caused the trigger is selected to receive the bonus or a recipient selection may take place. In the example above, where a contribution results in $Z \geq f(x)$ that gaming device 10 would be triggered into the feature. Alternatively, when a trigger condition is detected a gaming device 10 to receive the feature may be, for example, randomly selected from participating and qualifying gaming devices 10.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A gaming device comprising:

a display for displaying game content;

one or more data structures storing data corresponding to game graphics and software for controlling the display of a base game and a game feature, said game feature including one or more free plays each producing and outcome and where each free play has an expected value≈EV;

a processor configured to access said data structure and control said display to display a base game and game feature each configured to randomly select a winning or losing outcome and for a winning outcome issue an award;

one or more of said processor and a progressive controller configured to (i) accumulate a progressive jackpot pool P; (ii) determine a feature trigger condition occurring based upon a predetermined condition; (iii) determine the progressive jackpot pool value PV to be awarded upon determination of said feature trigger, (iv) enable said feature for a number of free plays substantially equal to PV/EV; and (v) issue a feature award based upon any free play winning outcomes of the feature game.

2. The gaming device of claim 1 comprising one or more of said processor and a progressive controller are configured to, where EV is not an aliquot of PV resulting in a remainder amount R<EV, to provide a remainder game having odds substantially equal to R/EV for a winning outcome to award an additional feature free play.

3. The gaming device of claim 1 comprising a meter displaying the number of free plays enabled.

4. The gaming device of claim 1 comprising one or more of said processor and a progressive controller configured to accumulate a progressive jackpot pool P from a minimum amount $V_{Min}$ where EV is an aliquot of $V_{Min}$.

5. The gaming device of claim 1 comprising said data structure storing data corresponding to game graphics and software for controlling the display of a spinning reel game feature.

6. The gaming device of claim 1 comprising data structure storing data corresponding to game graphics and software for controlling the display of a base game and a game feature, said game feature including one or more free plays of said base game and where each free play has said expected value EV.

7. The gaming device of claim 1 comprising one or more of said processor and a progressive controller configured to randomly or pseudo-randomly determine said trigger condition.

8. The gaming device of claim 1 comprising one or more of said processor and a progressive controller configured to allocate an amount from each play of a base game to said jackpot pool P, randomly select a trigger jackpot value and when said jackpot pool reaches said trigger jackpot value determine occurrence of said trigger condition.

9. The gaming device of claim 1 comprising one or more of said processor and a progressive controller configured to (i) allocate an amount from each play of a base game to said jackpot pool P where $V_{Min} \leq P \leq V_{Max}$ and $V_{Min}$ is a minimum value of P and $V_{Max}$ is a maximum value of P and (ii) for each base game play determine a probability of a trigger condition where said probability approaches 1 as P approaches $P_{Max}$.

10. The gaming device of claim 9 comprising one or more of said processor and a progressive controller are configured to, where EV is not an aliquot of PV resulting in a remainder amount R<EV, to provide a remainder game having odds of R/EV for a winning outcome to award an additional free play.

11. A system including a plurality of gaming devices comprising:

each gaming device including a video display for displaying game content to a player thereof;

one or more data structures storing data corresponding to game graphics and software for controlling at said gaming devices the display of a base game and a game feature, said game feature including one or more free plays each producing and outcome and where each free play has an expected value≈EV;

one or more processors configured to access said one or more data structures and control the display of base games and game features at said gaming devices each configured to randomly select a winning or losing outcome and for a winning outcome issue an award;

one or more of said processors and one or more progressive controllers configured to (i) accumulate a progressive jackpot pool P; (ii) determine a feature trigger condition; (iii) determine the progressive jackpot pool value PV upon determination of said feature trigger condition, (iv) enable said feature for a number of free plays at one or more gaming devices substantially equal to PV/EV; and (v) issue a feature award based upon any free play winning outcomes of the feature game.

12. The system of claim 11 comprising one or more of said processors and one or more of said progressive controllers configured to, where EV is not an aliquot of PV resulting in a remainder amount where R<EV, to provide a remainder game having odds substantially equal to R/EV for a winning outcome awarding an additional feature free play.

13. The system of claim 11 comprising said feature free play is a free play of a spinning reel game.

14. The system of claim 11 where each gaming device is configured to accept a wager by a player to play a base game, said system comprising one or more of said processors and progressive controllers are configured to allocate an amount from each wager to said jackpot pool P, randomly select a jackpot trigger value and when said jackpot pool reaches said selected jackpot trigger value determine said trigger condition is satisfied.

15. The system of claim 11 where each gaming device is configured to accept a wager by a player to play a base game, said system comprising one or more of said processors and progressive controllers configured to (i) allocate an amount from each wager W to said jackpot pool P where $V_{Min} \leq P \leq V_{Max}$ and $V_{Min}$ is a minimum value of P and $V_{Max}$ is a maximum value of P and (ii) for each base game play determine a probability of a trigger condition where said probability approaches 1 as P approaches $V_{Max}$.

16. The system of claim 15 comprising one or more of said processors and progressive controllers are configured to, where EV is not an aliquot of PV resulting in a remainder amount R<EV, to provide a remainder game having odds of R/EV for a winning outcome to award an additional free play.

17. A method for providing a game feature to award a progressive jackpot pool P to one or more networked gaming devices, each gaming device including a display and apparatus to accept a wager from player to play a base game, said method comprising:

configuring at least one controller to allocate a portion of said wagers to a progressive jackpot value pool P;

providing for the determination of a trigger condition for awarding a jackpot value PV to one or more players;

in response to said trigger condition (i) enabling a feature including a number of free plays at said display of at least one gaming device substantially equal to PV/EV where EV is the expected value of said free plays and each free play results in a winning or losing outcome and (ii) issuing an award to said at least one gaming device for any winning free play outcomes.

18. The method of claim 17 comprising, where EV is not an aliquot of PV resulting PV/EV having a remainder amount R<EV, enabling a remainder game having odds substantially equal to R/EV for a winning outcome to award an additional feature free play.

19. The method of claim 17 including a minimum progressive jackpot pool value $V_{Min}$ and a maximum jackpot pool value $V_{Max}$ where $V_{Min} \leq P \leq V_{Max}$, said method comprising one of (a) randomly selecting a trigger jackpot value and when P=said trigger jackpot value determining said trigger condition and (b) for each base game play determining a probability of a trigger condition according to a function where said probability increases from a minimum probability at $V_{Min}$ and approaches 1 as P approaches $V_{Max}$.

20. The method of claim 19 comprising where EV is not an aliquot of PV resulting PV/EV having a remainder amount R<EV, enabling a remainder game having odds substantially equal to R/EV for a winning outcome to award an additional feature free play.

* * * * *